US006523491B1

(12) United States Patent
Moïse, II et al.

(10) Patent No.: US 6,523,491 B1
(45) Date of Patent: Feb. 25, 2003

(54) LIFT BOAT

(75) Inventors: Benjamin Clay Moïse, II, New Orleans, LA (US); Anthony V. Barrois, Gretna, LA (US)

(73) Assignee: Textron Inc., New Orleans, LA (US)

( * ) Notice: Subject to any disclaimer, the term of this patent is extended or adjusted under 35 U.S.C. 154(b) by 0 days.

(21) Appl. No.: 09/711,459

(22) Filed: Nov. 13, 2000

Related U.S. Application Data

(60) Provisional application No. 60/165,214, filed on Nov. 12, 1999.

(51) Int. Cl.[7] ..... B63B 35/44; E02B 17/08

(52) U.S. Cl. ..... 114/265; 405/296

(58) Field of Search ..... 114/44, 230.1, 114/258, 264, 265, 268, 294; 405/196, 198, 203; 212/307, 308

(56) References Cited

U.S. PATENT DOCUMENTS

| | | | | | |
|---|---|---|---|---|---|
| 2,308,743 | A | * | 1/1943 | Bulkley et al. | 405/198 |
| 2,334,992 | A | * | 11/1943 | Crake | 114/264 |
| 3,628,336 | A | * | 12/1971 | Moore et al. | 405/196 |
| 3,727,414 | A | * | 4/1973 | Davies | 405/196 |
| 4,112,863 | A | * | 9/1978 | Nelson | 114/264 |
| 4,254,730 | A | * | 3/1981 | Crenshaw | 114/294 |
| 4,325,654 | A | * | 4/1982 | Meckler | 405/196 |
| 4,455,109 | A | * | 6/1984 | Lorenz | 405/203 |
| 4,652,177 | A | * | 3/1987 | Gunther, Jr. et al. | 405/196 |
| 4,846,357 | A | * | 7/1989 | Sholl et al. | 212/307 |
| 5,188,484 | A | * | 2/1993 | White | 405/198 |
| 5,190,410 | A | * | 3/1993 | Nunley | 405/196 |
| 5,855,455 | A | * | 1/1999 | Williford et al. | 405/196 |

FOREIGN PATENT DOCUMENTS

| | | | | |
|---|---|---|---|---|
| FR | 1419936 | * | 11/1964 | 405/196 |

* cited by examiner

*Primary Examiner*—S. Joseph Morano
*Assistant Examiner*—Andy Wright
(74) *Attorney, Agent, or Firm*—Garvey, Smith, Nehrbass & Doody, L.L.C.; Seth M. Nehrbass; Charles C. Garvey, Jr.

(57) ABSTRACT

An improved lift boat includes a hull, a plurality of legs (preferably three), a plurality of pads, one pad attached to each leg, and a jacking mechanism for moving each upward and downward. Recesses in the hull receive the pads when the lift boat is underway. Preferably, the total bottom surface area of the pads is at least 30% of the surface area of the deck of the lift boat Preferably, the total bottom surface area of the pads is large enough such that, when the boat is loaded to capacity and is jacked up, the pads exert pressure of less than 7 p.s.i. on the sea floor. Preferably, the pads are partially recessed into the hull and extend laterally outward from the hull when the boat is underway to provide increased stability to the lift boat when it is underway.

19 Claims, 4 Drawing Sheets

FIG. I.

LIFT BOAT

CROSS-REFERENCE TO RELATED APPLICATIONS

Priority of U.S. Provisional Patent Application Serial No. 60/165,214, filed Nov. 12, 1999, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to lift boats that feature a hull having a plurality of legs, each leg having an associated jacking mechanism that enables the hull to be elevated or lowered relative to the legs and wherein each leg has a load bearing pad that engages the seabed during use. More particularly, the present invention relates to an improved lift boat having an improved leg, hull and pad configuration with improved stability, when jacked up and when underway, featuring port and starboard pads near the bow of the hull that extend laterally of the hull in respective port and starboard directions and that extend into recesses of the hull.

2. General Background of the Invention

Lift boats are well known in the art. These devices (sometimes called jack up barges or jack up rigs) include a floating hull that allows the boat to be transferred from one marine location to another. When the hull reaches a desired location, such as a proposed oil well or other job site, typically three or four legs are lowered from the hull or barge to the sea bed. These legs are then powered downwardly with jacking mechanisms to lift the hull vertically on the legs and above the water's surface. Once in operating position, a jack-up rig presents a stable platform surface for oil and gas well drilling operations, work-over operations, repair or maintenance work etc., notwithstanding the wave action at the water surface below.

There have been many patents that have issued relating to jack-up rigs. An example of a recent patent that discloses a jack-up rig is U.S. Pat. No. 5,139,366 issued to Kenneth Choate and John Laird entitled "OFFSHORE JACK-UP RIG LOCKING APPARATUS AND METHOD". The Choate et al. patent provides a locking apparatus and method for an offshore jack-up rig having at least one leg extending through the hull and at least one set of rack teeth attached to each of the legs. One or more locking bars are supported from the hull and are movable in a direction substantially normal to the face of the rack teeth. A piston and cylinder power assembly moves the bars towards the teeth and a retention system engages the bars holding them in engagement with the teeth. The elevating system of the rig co-acts with the set bars to lock the hull and legs together.

Another recent patent that relates to jack-up rigs and explains there operation is U.S. Pat. No. 4,813,814 entitled "LEG-HOLDING DEVICE FOR OFFSHORE PLATFORM".

Other examples of patents that have issued and relate generally to jack-up rigs include U.S. Pat. Nos. 4,722,640; 4,627,768; 4,589,799; 4,505,616; and 4,482,272.

A patent that illustrates the elevating and lowering of a jack-up rig in a marine environment is U.S. Pat. No. 5,224,798, entitled "OVERLOADING DEVICE FOR A JACK-UP OIL PLATFORM AND PLATFORM INCLUDING THE DEVICE" (see FIGS. 4*a*–4*f*).

A common element of a lift boat is a lifting crane that can be used to lift supplies from its own deck, work boat, supply boat or the like, and place those supplies on the platform. Patents have issued that are directed to the placement of a crane on a jack up barge. Some years ago, a patented crane apparatus was designed to fit over the leg of a smaller sized lift boat wherein the leg was of a cylindrical pipe configuration. U.S. Pat. No. 4,417,664 disclosed generally the concept of mounting a crane having a gantry and a boom about the leg of a lift boat. Another patent that addressed the problem of mounting a crane on a jack-up rig (lift boat) where there is limited space is U.S. Pat. No. 4,652,177. This patent proposes to mount the crane on the jacking structure or jacking tower of the jack-up rig (lift boat).

The following U.S. Patents are incorporated herein by reference: U.S. Pat. Nos. 2,308,743; 3,183,676; 3,290,007; 3,367,119; 3,606,251; 3,750,210; 3,945,450; 3,967,457; 4,417,664; 4,456,404; 4,678,165; 4,813,814; 5,139,366; 5,580,189; 5,797,703; and all patents mentioned herein.

BRIEF SUMMARY OF THE INVENTION

The apparatus of the present invention provides an improved lift boat having an improved configuration for its hull, legs, pads as well as placement of permanent deck loads such as the crane and deck house relative to the hull and pads (especially when underway).

What is provided is a lift boat having an improved configuration of hull, legs and pads, including three legs with relatively large pads on the legs which recess partially into the hull of the boat, and which extend partially outwardly and laterally when under way.

In the preferred embodiment, a portion of at least some of the pads extend laterally (eg. one pad to port and one pad to starboard) of the hull. The pads extend beyond the periphery of the hull, and can thus be much larger. This greater surface area of pads in contact with the sea floor lessens the likelihood there is that there will be a "punch through" of a leg into the sea floor, which would cause the boat to be unbalanced and possibly fall over. Additionally, these laterally extending pads supplement the aggregate buoyancy of the hull in normal underway operation.

There can optionally be included a sounding device in the bottom of each leg to assess the thickness of the crust of the sea floor. The sounding devices can be commercially available sonar devices which tie into the oscilloscope on the boat.

The purpose of the unique features of the present invention described herein is to improve the overall efficiency of the lift boat into which they are incorporated in several aspects. These features significantly increased load carrying capacity compared to conventional lift boats. Improved hydrodynamic performance is realized due to the shaping of the hull, the pads, and the beneficial combination of the combined shapes of the hull and forward pads with the pads in the retracted (or 'up') position.

The unique lift boat features of the present invention thus include oversized buoyant pads or structural footings attached to the bottom of each leg to support the increased payload weight the lift boat carries both in the hullborne (hull floating) and 'jacked-up' (legs in the 'down' position placing the pads on the sea-bottom with the lift boat suspended completely above the sea surface) modes.

By positioning the forward pads below the waterline in the 'up' or retracted position, the pads supplement the aggregate buoyancy of the boat in normal underway operation. An improved configuration or shaping of the forward part of the hull and the forward pads form a combined shape having reduced hydrodynamic drag, such that, though having a larger payload capacity, this lift boat satisfactorily operates with no more propulsion power than conventional lift boats. An improved, beneficial shaping of the hull above the forward pads increases its hydrostatic buoyant volume relative that of conventional lift boats for improved safety and stability.

The present invention is an improvement over the methods now being used in the prior art. The laterally extending and thus larger pads provide a larger footing on the sea floor so that down pressure on the sea bottom is reduced from that of current conventional lift boats for improved safety through reduced risk of sea bottom collapse under the pad contact pressure.

The larger forward pads are underwater in the normal 'up' position so that their buoyant volume is additive into the total buoyant volume of the boat. In the prior art, the normal practice is for such pads to be suspended above the waterline in the 'up' position).

The hull forward end, above and below the waterline, is uniquely shaped to increase its buoyant volume and to provide shaped recesses into which the pads retract in the 'up' position. The resulting aggregate or combined shape is designed for reduced drag compared to the conventional barge-like hull and irregularly immersed pads of a conventional loaded lift boat operating underway in wave conditions.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
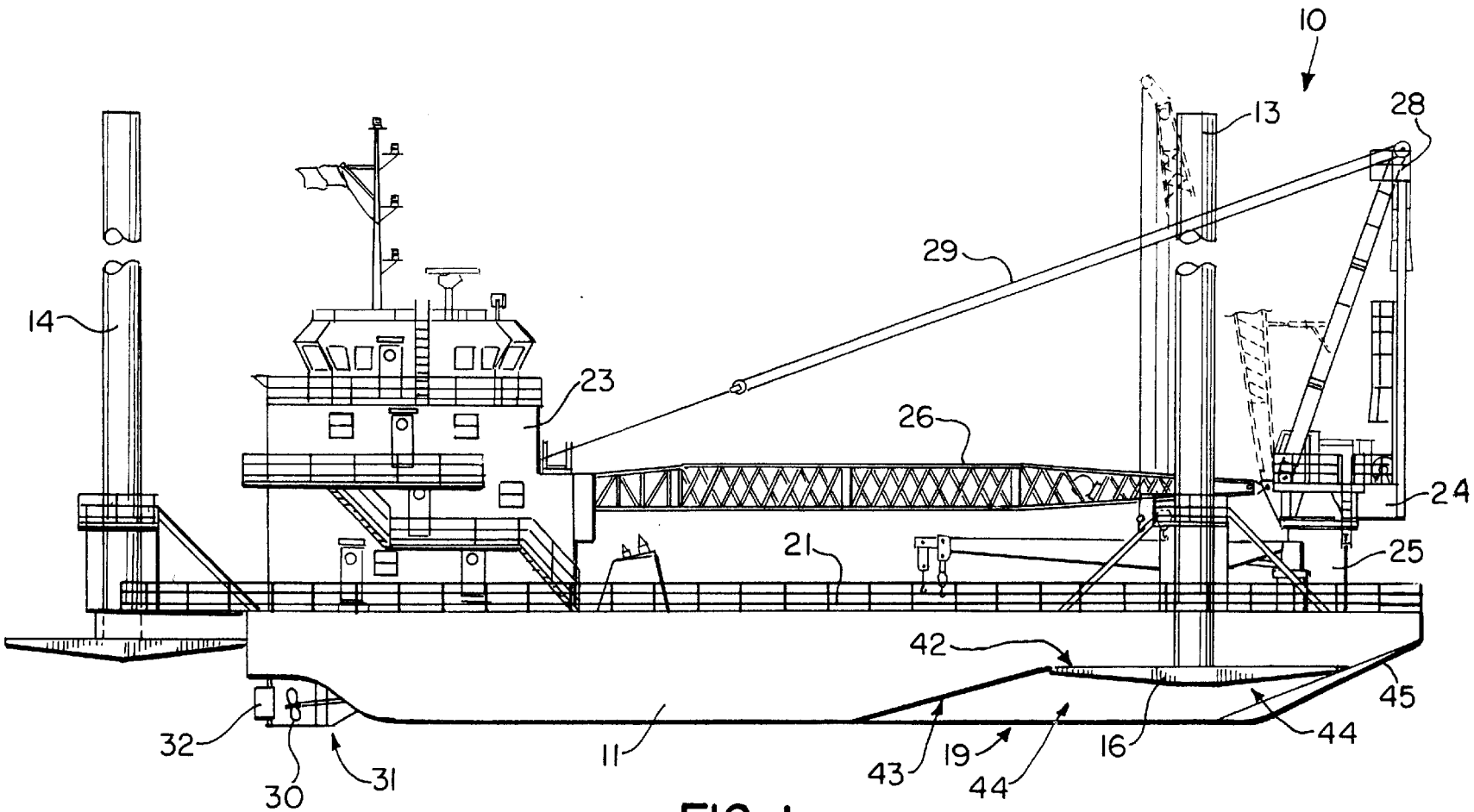
FIG. 1 is a side elevation view of the preferred embodiment of the apparatus of the present invention.
Figure 2:
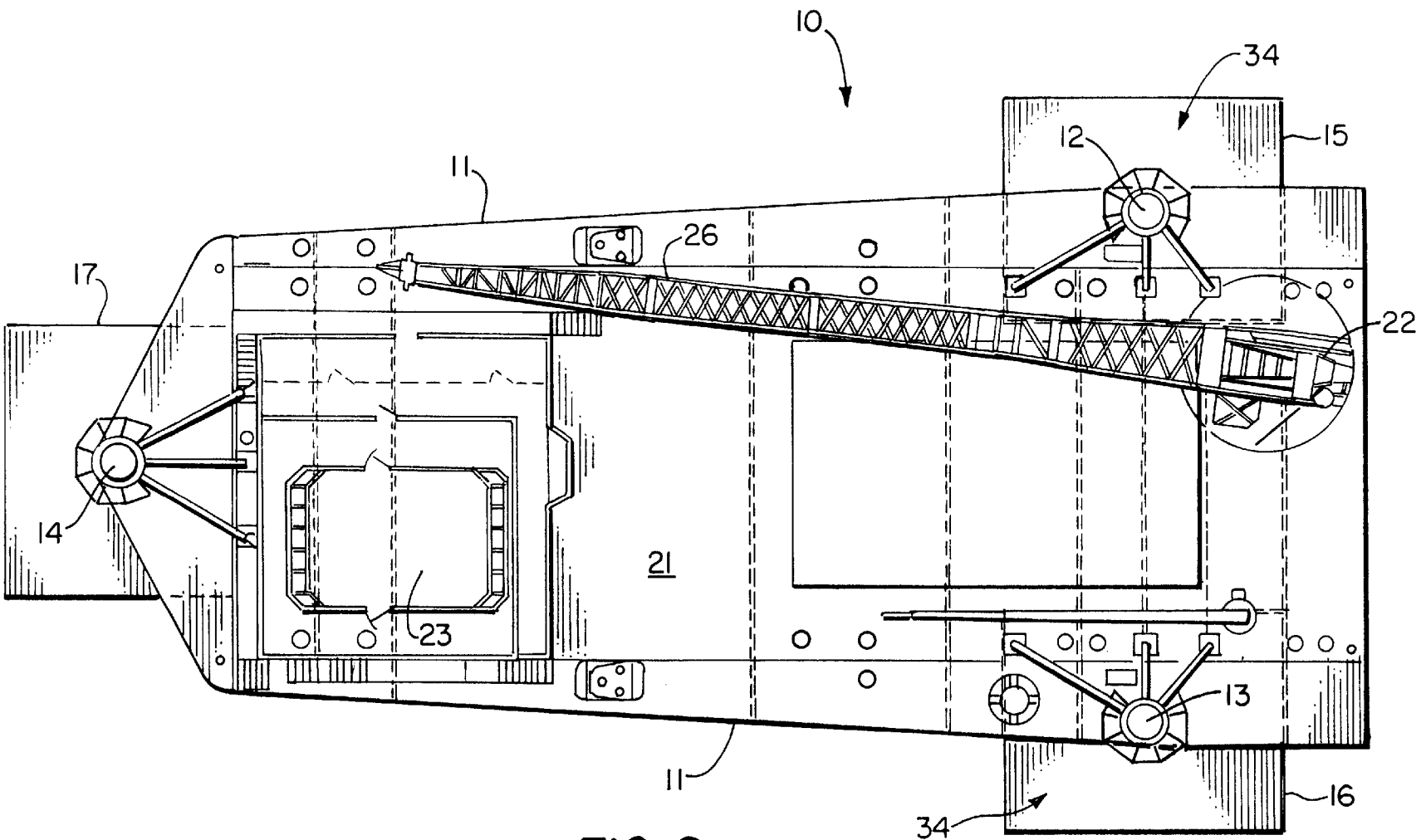
FIG. 2 is a top plan view of the preferred embodiment of the apparatus of the present invention.

FIGS. 1–2 show the preferred embodiment of the apparatus of the present invention, designated generally by the numeral 10 in FIGS. 1 and 2.

Lift boat 10 has a hull 11 and three legs 12, 13, 14 each having pads 15, 16, 17 on the legs 12, 13, 14 respectively which recess into the hull 11 of the boat 10. The side pads 15, 16 retract into side recesses 18, 19 in hull 12. The rear pad 17 retracts into rear recess 20 in hull 12. The larger the pads 15–17 (that is, the greater the surface area of the pads 15–17 in contact with the sea floor), the less likelihood there is that there will be a "punch through" of a leg 12–14 into the sea floor, which would cause the boat 10 to be unbalanced and possibly fall over.

The purpose of the unique features of the present invention described herein is to provide a lift boat 10 of improved configuration, having better overall efficiency. The apparatus 10 of the present invention significantly increased load carrying capacity compared to conventional comparably sized lift boats. The present invention provides improved hydrodynamic performance due to the shaping of the hull 11, the pads 15–17, the beneficial combination of the combined shapes of the hull 11 and forward pads 15–16 with the pads 15–16 in the retracted (or 'up') position (see FIGS. 1 and 6).

Pads 15–17 are structural footings attached to the bottom of each leg 12–14 respectively to support the increased payload weight the lift boat 10 carries both in the hullborne (hull 11 floating) and 'jacked-up' (legs 12–14 in the 'down' position (shown in phantom lines in FIG. 3) placing the pads 15, 16, 17 on the sea-bottom with the lift boat hull 11 suspended completely above the sea surface) modes. The forward pads 15–16 are positioned below the waterline in the 'up' or retracted position to supplement the aggregate buoyancy of the hull 11 in normal underway operation.

An improved shaping of the forward part of the hull 11 and the forward pads 15, 16 to form a combined shape having reduced hydrodynamic drag, such that, though having a larger payload capacity, this lift boat 10 satisfactorily operates with no more propulsion power than conventional lift boats. Improved shaping of the hull 11 and the recesses that recline the forward pads 15, 16 increase its hydrostatic buoyant volume relative that of conventional lift boats for improved safety and stability.

The present invention is an improvement over the methods now being used in the prior art. The larger pads 15–17 provide a larger footing on the sea floor so that down pressure on the sea bottom is reduced from that of current conventional lift boats for improved safety through reduced risk of sea bottom collapse under the pad contact pressure. The larger forward pads 15, 16 are underwater in the normal 'up' position so that their buoyant volume is additive into the total buoyant volume of the boat 10. The normal practice is for such pads to be suspended above the waterline in the 'up' position.

The hull 11 bow end, above and below the waterline, is uniquely shaped (see FIGS. 1 and 6) to increase its buoyant volume and to provide shaped recesses 18, 19 into which the forward pads 15, 16 respectively retract in the 'up' position. The resulting aggregate or combined shape is designed for reduced drag compared to the conventional barge-like hull and irregularly immersed pads of a conventional loaded lift boat operating underway in wave conditions.

Deck house 23 rests on and is secured to deck 21 of hull 11. Deck 21 also holds and supports crane 22 having cab 24, crane support 25 and boom 26. Crane 22 also includes gantry 28 and rigging 29. In the preferred embodiment, crane 22 support 25 is positioned generally in between legs 12 and 13 as shown in FIG. 2. Deck house 23 is positioned at the stern of hull 11, next to leg 14 as shown in FIG. 2. Boom 26 can extend substantially the full length of hull 11, extending to one side of deck house 23 when boom 26 is lowered (see FIG. 2).

Hull 11 is preferably wider fore than aft, and includes forward recesses 18, 19 for receiving the forward pads 15,

16 respectively. A rear recess 20 receives the rear pad. Forward recesses 18, 19 extend inward from the sides of the hull 11 and are preferably only slightly larger laterally than necessary to receive the portion of forward pads 15, 16 which are positioned below them when the lift boat 10 is jacked up. Pads 15, 16 taper in an aft direction to provide as little water resistance as possible.

Figure 3:
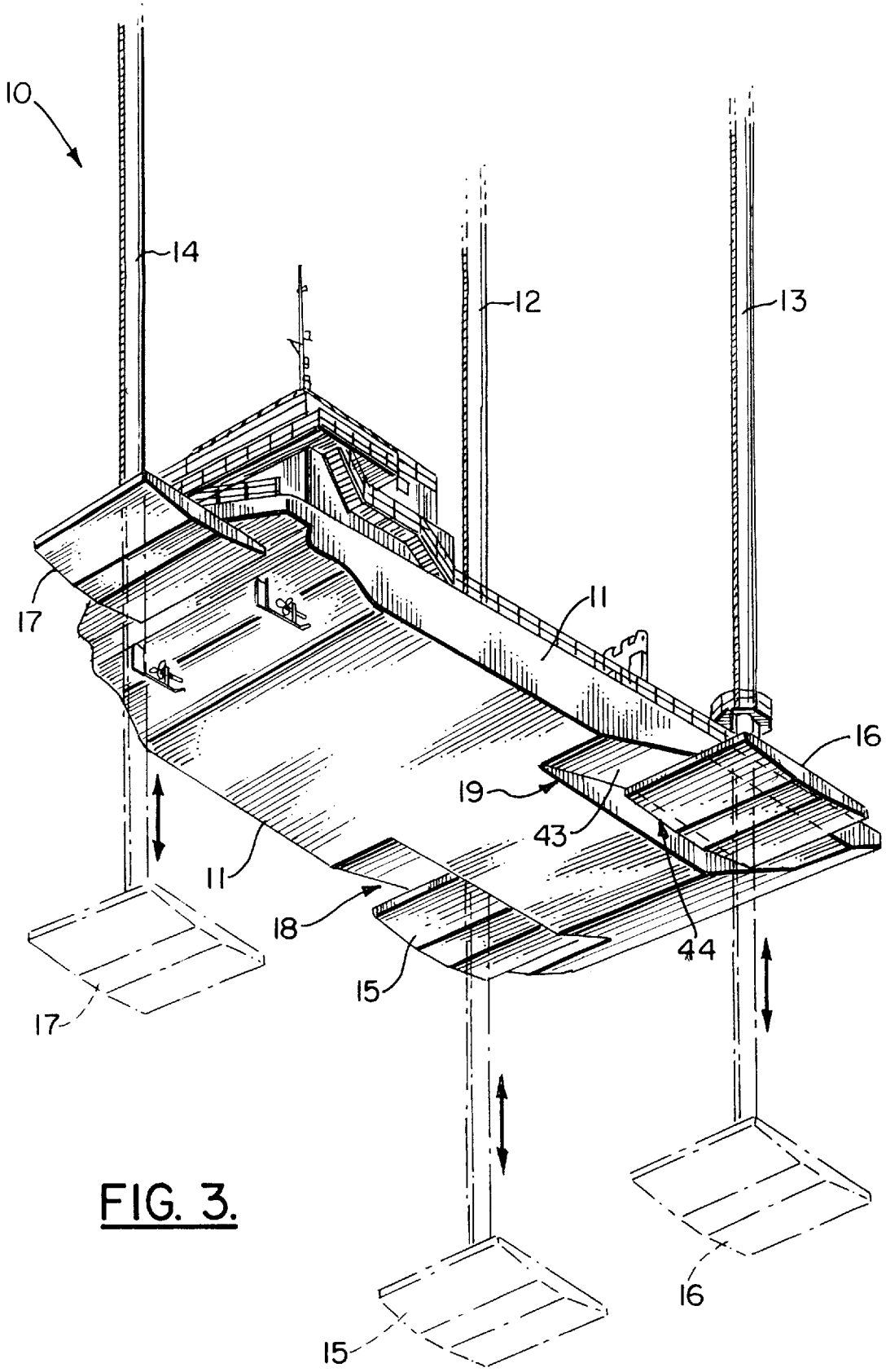
FIG. 3 is a perspective view illustrating the preferred embodiment of the apparatus of the present invention and showing the underside of the hull and the recess portions that receive the port and starboard pads.
Figure 4:
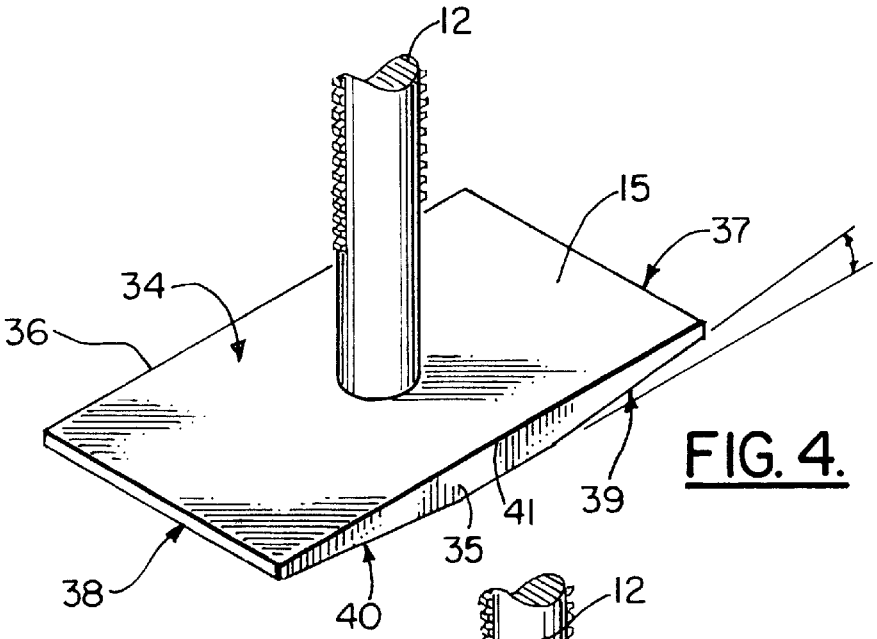
FIG. 4 is a partial, perspective view of the preferred embodiment of the apparatus of the present invention illustrating the pad portion thereof.
Figure 5:
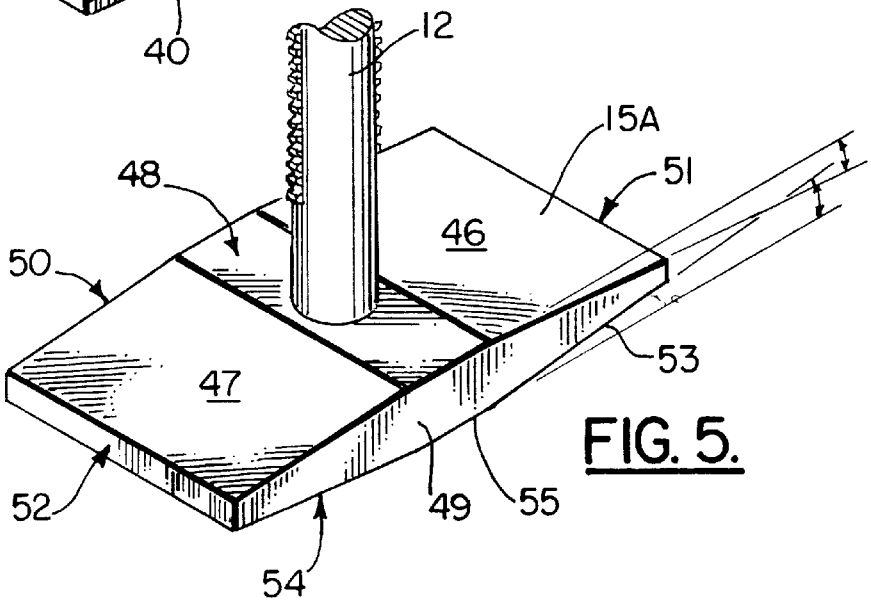
FIG. 5 is a partial, perspective view of the pad showing an alternate construction for the pad.
Figure 6:
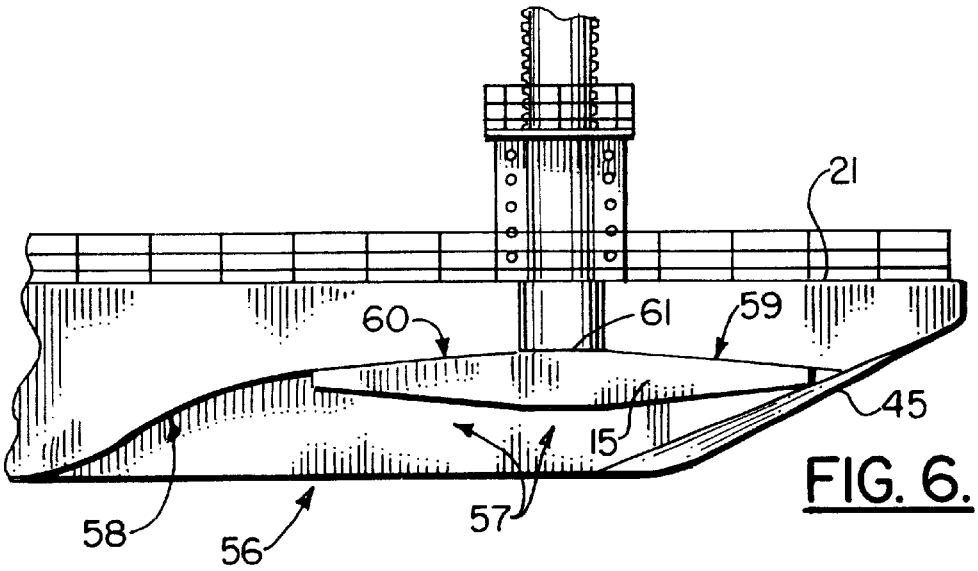
FIG. 6 is a partial, elevation view showing an alternate construction for a forward pad and its recess.

FIGS. 1, 3 and 4–6 show more specifically the configuration of each of the pads 15, 16 that fit the respective recesses 18, 19 at the port and starboard portions of the bow of hull 11 as shown in the drawings. In FIG. 4, the preferred construction for pad 15 is shown. The construction of pad 16 is preferably the same as the construction shown in FIG. 4 for pad 15. Similarly, the construction of pad 17 can be the same as for the pad 15 shown in FIG. 4. FIG. 5 shows an alternate construction for the pads 15, 16, the pad in FIG. 5 being designated generally by the numeral 15A. It should be understood that the pad 15A can be used as a substitute for the pads 15, 16, especially when coupled with the hull shape provided at recess 56 as shown in FIG. 6.

In FIG. 4, pad 15 has upper surface 34, generally vertical, flat sides 35, 36 and front and rear substantially vertical surfaces 37, 38. The bottom of each of the pads 15, 16 provides an inclined bottom surface 39 at the front of the pad 15 or 16 and an inclined surface 40 at the rear of the pad 15 or 16. Horizontal bottom surface 41 can be provided in between the inclined surfaces 39, 40.

In FIGS. 1 and 3, hull 11 provides at recess 19 (and also for recess 18) a horizontal surface 42 that receives the upper surface 34 of pad 15 as shown in FIG. 1. The portion of pad 15 that is contained within recess 19 contacts the hull 11 as shown in FIG. 1. Specifically, a portion of the upper surface 34 of pads 15 and 16 fits against the generally flat, horizontal surface 42 of hull 11 at recesses 18 and 19. Aft inclined surface 43 extends from rear vertical surface 38 of pad 15 or 16 and also from the rear end of horizontal surface 42. Each recess 18, 19 also includes a vertical surface 44. When each of the pads 15, 16 is in the upper, retracted position shown in hard lines in FIGS. 1 and 3, an innermost side of each pad 15, 16 fits closely against vertical surface 44 of hull 11 at a recess 18 or 19. For example, in FIGS. 1 and 3, the side 36 of pad 16 fits closely against the vertical surface 44 of hull 11 at recess 19. The front rake portion of hull 11 is shown in FIGS. 1 and 3. Recesses 18, 19 are open at rake 45 as shown so that the bottom of each pad 15, 16 at surface 39 (or 53 of pad 15A) meets the water surface as the hull 121 travels in a forward direction.

An alternate construction for either of the pads 15, 16 is shown in FIG. 5, designated by the numeral 15A. Pad 15A is similar to pad 15 shown in FIG. 4, differing in that its upper surface has the same general configuration as its undersurface. Thus, pad 15A has a front upper inclined surface 46, rear upper inclined surface 47, and upper horizontal surface 48 in between the surfaces 46 and 47. As with pads 15 and 16, pad 15A has generally vertical sides 49, 50, a forward vertical surface 51 and a rear vertical surface 52.

The bottom of pad 15A has the same general bottom configuration as the pad 15 or 16 shown in FIG. 4. Thus, pad 15A has a forward, inclined bottom surface 53, aft inclined bottom surface 54, and horizontal bottom surface 55 that is in between the surfaces 53 and 54. The pad 15A fits an alternate construction of recess 56 that is shown in FIG. 6. The recess 56 has vertical surface 57, aft curved hull surface 58, and surfaces that engage the upper surfaces of pad 15A, including forward inclined hull surface 59, rear inclined hull surface 60, and horizontal hull surface 61. As with the preferred embodiment, recess 56 is open at rake 45 so that the inclined surface 53 meets the water surface as the hull travels in a forward direction.

Rear recess 20 extends laterally from one side of the hull to the other. Adjacent and fore of the rear recess 20 is a recess 31 for propellers 30 and rudders 32.

Portions of the pads 15, 16 (or 15A) extend laterally outward from the hull 11 as shown in FIG. 2. This construction helps to stabilize the lift boat 10 both when the boat 10 is underway and when the hull 11 is jacked up, as it increases the effective surface area of the lift boat 10 by the amount that the pads extend outward makes the pads further away from the center of gravity of the boat than in conventional lift barges.

The total bottom surface area of the pads 15–17 is preferably at least 30% of the surface area of the deck 21 of the lift boat hull 11, more preferably at least 35% of the surface area of the deck 21 of the lift boat hull 11, and most preferably at least 50% of the surface area of the deck 21 of the lift boat hull 11. Typically, each pad would have about the same surface area as every other such pad.

The total bottom surface area of the pads 15–17 is large enough such that, when the boat 10 is loaded to capacity and hull 11 is jacked up, the pads 15–17 exert pressure of less than 7 p.s.i. on the sea floor, more preferably less than 6 p.s.i., and most preferably less than 5 p.s.i.

There is preferably also included a sounding device (not shown) in the bottom of each leg 12–14 (and preferably located in the bottom of the pads 15–17) to assess the thickness of the crust of the sea floor. The sounding devices can be commercially available sonar devices which tie into the oscilloscope (not shown) on the boat 10.

PARTS LIST

The following is a list of parts and materials suitable for use in the present invention:

10 lift boat
11 hull
12 leg
13 leg
14 leg
15 pad
15A pad
16 pad
17 pad
18 side pad-receiving recess
19 side pad receiving recess
20 rear pad-receiving recess
21 deck
22 crane
23 deck house
24 cab
25 crane support
26 boom
28 gantry
29 rigging
30 propeller
31 recess
32 rudder
33 recess
34 upper surface

35 side
36 side
37 forward vertical surface
38 rear vertical surface
39 inclined bottom surface
40 inclined bottom surface
41 horizontal bottom surface
42 horizontal surface
43 aft inclined surface
44 vertical surface
45 forward rake
46 front upper inclined surface
47 rear upper inclined surface
48 upper horizontal surface
49 side
50 side
51 forward vertical surface
52 rear
53 forward inclined bottom surface
54 aft inclined bottom surface
55 horizontal bottom surface
56 recess
57 vertical surface
58 curved hull surface
59 forward inclined hull surface
60 rear inclined hull surface
61 horizontal hull surface As used herein "buoyant" means buoyant in the water in which the lift boat operates.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the of the present invention is to be limited only by the following claims.

What is claimed is:

1. A lift boat, comprising:

a) a hull having a stem and a bow with a forward rake portion;

b) a plurality of legs movably attached to the hull;

c) a powered jacking mechanism for elevating and lowering each leg relative to the hull;

d) a plurality of pads, one pad attached to each leg;

e) recesses in the hull that extend to the forward rake portion for receiving the pads when the lift boat is underway, the recesses including at least one inclined surface and at least one generally horizontal surface, wherein the pads include port and starboard pads that are positioned near the bow of the hull and that are positioned in front of an inclined surface of each respective recess that gradually lowers in elevation as said inclined surface extends aft and away from the pad.

2. The lift boat of claim 1, wherein the lift boat has a deck surface area which is next to the top of the hull and wherein the pads have a total bottom surface area which is the sum of the bottom surface area of all of the pads, and wherein the total bottom surface area of the pads is at least 30% of the deck surface area.

3. The lift boat of claim 2, wherein each pad has about the same surface area as every other pad.

4. The lift boat of claim 1, wherein the lift boat has a deck surface area which is the surface area of the top of the hull as viewed in plan, the pads having a total bottom surface area which is the sum of the bottom surface area of all of the pads, and wherein the total bottom surface area of the pads is large enough such that the pads exert pressure of less than about 7 p.s.i. on the sea floor during use.

5. The lift boat of claim 4, wherein each pad has about the same surface area as every other pad.

6. The lift boat of claim 1, wherein the hull has port and starboard portions and a part of each of the pads extends laterally outward from the hull and beyond the port and starboard portions when the boat is underway.

7. The lift boat of claim 1, wherein at least some of the pads are positioned at least partially below the waterline when the pads are in a fully up position.

8. The lift boat of claim 1 wherein the pads are buoyant.

9. The lift boat of claim 1 wherein the pads supplement the aggregate buoyancy of the hull when underway.

10. The lift boat of claim 1 further comprising a propeller on the hull for powering the hull.

11. A lift boat comprising:

a) a hull having bow and stern portions and port and starboard portions and a forward rake surface next to the hull bow position;

b) a plurality of legs connected to the hull;

c) a plurality of pads, one pad attached to each leg;

d) jacking mechanisms on the hull for moving the legs upward and downward relative to the hull;

e) recesses in the hull for receiving the pads when the lift boat is underway, wherein the lift boat has a deck surface area which is the surface area of the top of the hull as viewed in plan, the pads have a total bottom surface area which is the sum of the bottom surface area of all of the pads, and wherein the total bottom surface area of the pads is equal to at least 30% of the surface area of the deck of the lift boat; and f) wherein two of the recesses have a forward open portion that communitites with and extend to the forward rake surface.

12. The lift boat of claim 11, wherein each pad has about the same surface area as every odther pad.

13. The lift boat of claim 11, wherein the total bottom surface arrea of the pads is larget enough such that the pads exert pressure of less than 7 p.s.i. on the sea floor during use.

14. The lift boat of claim 13, wherein each pad has about the same surface area every other pad.

15. The lift boat of claim 11, wherein the pads are recessed into the hull and have portions that extend laterally away from the hull when the boat is underway.

16. The lift boat of claim 11 wherein at least some of the pads are positioned at least partially below the waterline when the pads are in a fully up position.

17. The lift boat of claim 11 wherein the pads are buoyant.

18. The lift boat of claim 11 wherein the pads supplement the aggregate buoyancy of the hull when underway.

19. The lift boat of claim 11 further comprising a propeller on the hull for powering the hull.

* * * * *